US006541904B1

(12) United States Patent
Compen

(10) Patent No.: US 6,541,904 B1
(45) Date of Patent: Apr. 1, 2003

(54) DISPLAY DEVICE PROVIDED WITH ANTI-AEF STRIP

(75) Inventor: Johannes M. A. A. Compen, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 09/566,503

(22) Filed: May 8, 2000

(30) Foreign Application Priority Data

May 7, 1999 (EP) ..... 99201438

(51) Int. Cl.[7] ..... H01J 31/00
(52) U.S. Cl. ..... 313/478; 313/461; 313/480
(58) Field of Search ..... 313/478, 477 R, 313/480, 461, 473, 474

(56) References Cited

U.S. PATENT DOCUMENTS 4,059,768 A * 11/1977 Van Landeghem et al. . 250/483
5,153,481 A * 10/1992 Matsuda et al. ..... 313/479
5,869,129 A * 2/1999 Aben et al. ..... 427/64
5,880,557 A * 3/1999 Endo et al. ..... 313/461
6,262,840 B1 * 7/2001 Watanabe et al. ..... 359/452

FOREIGN PATENT DOCUMENTS

JP 4249036 9/1992 ..... H01J/29/00
JP 04249036 A * 9/1992

* cited by examiner

*Primary Examiner*—Vip Patel
*Assistant Examiner*—Kevin Quarterman

(57) ABSTRACT

A display device includes a display screen, a surface of which is provided with an anti-reflection filter having a conducting layer having metallic particles and transparent areas. The conducting layer is provided with a transparent layer. The transparent layer has a thickness smaller than or equal to the thickness of the conducting layer. The display screen is provided with at least one electrically conducting strip having a metal layer and an adhesive layer provided with electrically conducting particles. The electrically conducting strip is in local electrical contact with the metallic particles of the anti-reflection filter via the conducting particles of the adhesive layer.

6 Claims, 4 Drawing Sheets

DISPLAY DEVICE PROVIDED WITH ANTI-AEF STRIP

FIELD OF THE INVENTION

The invention relates to a display device comprising a display screen, a surface of which is provided with an anti-reflection filter having a conducting layer comprising metallic particles and transparent areas, the conducting layer being provided with a transparent layer. The invention also relates to a picture display apparatus.

BACKGROUND AND SUMMARY OF THE INVENTION

WO 98/49707 describes a display device provided with an anti-static and anti-reflection filter. Such a filter has a conducting layer which comprises metal particles and transparent particles shielded by a further transparent layer. The metal particles provide for the conductance and the transparent particles provide for the transmission of light. The assembly of the conducting and shielding transparent layer has a very low reflection. Such filters are provided on the display screen of a display device, for example, on cathode ray tubes or a plasma display panel (PDP).

For use of a display device as a computer monitor, where the user is relatively close to the display screen, the display device must satisfy stringent standards relating to the so-called AEF field (Alternating Electric Field). The AEF field is an unwanted electromagnetic field which should have a minimal intensity. The AEF field can be reduced by providing the display screen with an electrically conducting layer which is at ground potential.

It is an object of the invention to provide a display device with a reduced AEF field. To this end, the display device according to the invention is characterized in that the transparent layer has a thickness (d2) which is smaller than or equal to the thickness (d1) of the conducting layer, the thickness of each layer (d1, d2) being measured from the surface of the display screen up to the upper side of the layer, the display screen being provided with at least one electrically conducting strip comprising a metal layer and an adhesive layer provided with electrically conducting particles, the electrically conducting strip being in local electrical contact with the metallic particles of the anti-reflection filter via the conducting particles of the adhesive layer.

The invention is also based on the recognition that, for a satisfactory shielding effect, it is of great importance to obtain a satisfactory electrical contact between the electrically conducting layer and the ground potential contact. The invention realizes a satisfactory electrical contact between the electrically conducting layer and the ground potential contact.

Practice has proved that larger clusters of metal particles comprised in the conducting layer of the anti-reflection filter protrude from the transparent layer. The inventors have recognized that this property provides an elegant possibility of preventing or reducing possible AEF fields. This is realized by providing one or more special conducting strips on the screen. A satisfactory electrical contact between the strip and the metal clusters is obtained by making use of a conducting strip which comprises a metal layer and an adhesive layer provided with electrically conducting particles. Due to these measures, a display screen is obtained in which a satisfactory electrical contact is realized between the electrically conducting layer and the ground potential contact.

The use of metal strips to prevent AEF fields is known per se from the English language abstract of Japanese patent application JP-A 04-249036. This document describes a display device with a display screen provided with a transparent electrically conducting layer. Strips of a metal foil which are in contact with the rim band provided around the screen and connected to earth are provided on the transparent layer. The electrical resistance of the electrically conducting layer must be as low as possible, for example, lower than 1000 ohm/square. Such conducting layers are usually provided on the display screen by means of a wet-chemical method in the final stage of the display tube production, in which a temperature step of maximally only 160° C. is allowed. As a result, layers having such a low resistance are difficult to manufacture and, moreover, are comparatively expensive. The above-mentioned abstract does not disclose the structure of the electrically conducting layer, nor does it disclose anything about the construction of the metal strips.

An embodiment of the electrically conducting strip is characterized in that at least 2% of the volume of the adhesive layer is filled with the electrically conducting particles. It has been found by experiments that, at such a value of the volume density, a good contact is obtained between the electrically conducting strip and the electrically conducting layer on the display screen.

An embodiment of the electrically conducting strip is characterized in that at least 30% of the volume of the adhesive layer is filled with the electrically conducting particles. It has been found by further experiments that, at such a value of the volume density, a good contact is obtained between the electrically conducting strip and the electrically conducting layer on the display screen.

An embodiment of the electrically conducting strip is characterized in that the strip has a width which is larger than or equal to 0.3 cm. It has been found that strips with such a width have a good conductivity, so that it is possible to reduce the number of required strips to only two or three. This results in a further reduction of costs.

An embodiment of the display device comprises a funnel-shaped portion which is secured to the display screen, which funnel-shaped portion is at least partly provided with an electrically conducting layer, and is characterized in that the conducting strip is also in electrical contact with the electrically conducting layer. In this embodiment, the customary means for bringing the electrically conducting layer to ground potential such as, for example, wire constructions can be dispensed with. This reduces the costs of the display device.

A second aspect of the invention relates to a display apparatus comprising means for generating a picture signal, and a display device as described hereinbefore for displaying the picture signal.

These and other aspects of the invention are apparent from and will be elucidated with reference to the embodiments described hereinafter.

BRIEF DESCRIPTION OF THE DRAWING FIGURES

In the drawings.

The Figures are diagrammatic and not to scale, while identical components are generally denoted by the same reference numerals.

DETAILED DESCRIPTION

Figure 1:
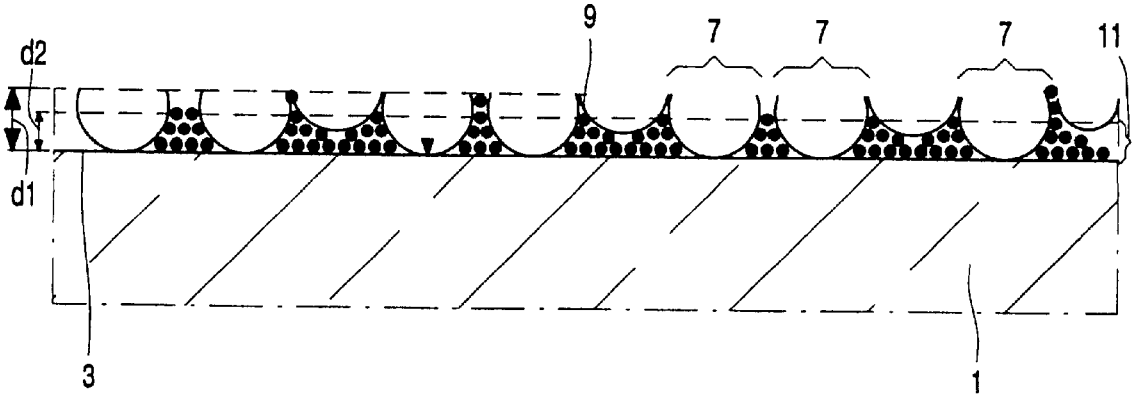
FIG. 1 is a cross-section of a display screen of a display device, provided with an anti-static, anti-reflection filter.

FIG. 1 is a diagrammatic cross-section of a known display screen 1, a surface 3 of which is provided with an anti-reflection filter. Conducting layer 5 comprises transparent areas 7 and metal particles 9. The average size of the metal particles is smaller than the average size of the transparent areas. The metal particles 9 fill the "holes" between the transparent areas 7 and are in contact with each other around the transparent areas so that they ensure electrical conductance. The thickness d1 of the conducting layer 5 is equal to the distance between the surface 3 of the display screen 1 and the upper side of the layer. The filter also comprises a further transparent layer 11 whose upper side is shown by way of a broken line in the Figure. This layer 11 largely shields the conducting particles 9 and also fills up the transparent areas 7. The thickness d2 of the layer 11 is smaller than or equal to the thickness d1 of the conducting layer 5. The layers 5 and 11 combined constitute the anti-reflection filter. Typically, d1 is in the range of 80–120 nm, and d2 is in the range of 10–50 nm.

Figure 2:
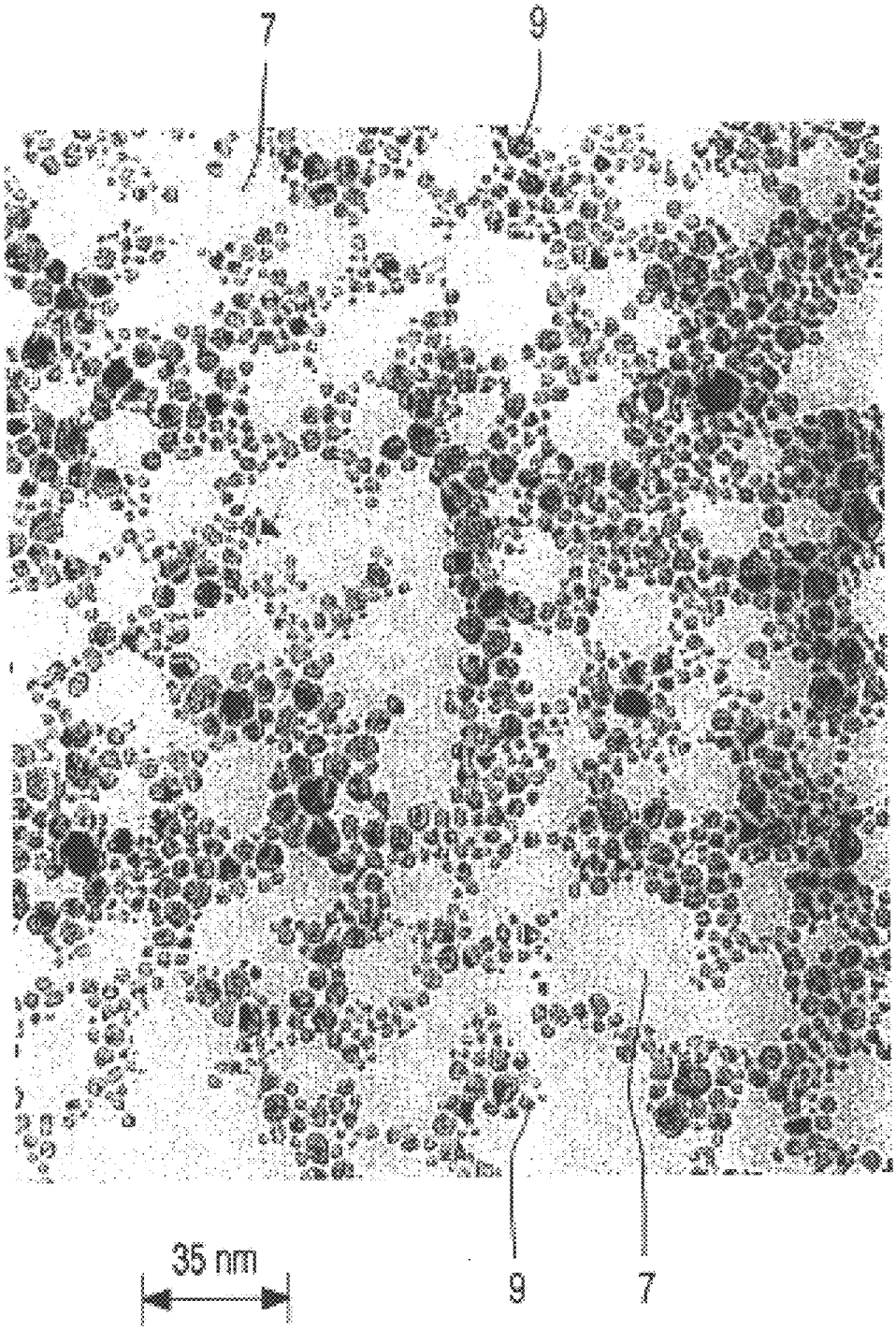
FIG. 2 is a plan view of a SEM photo of a conducting layer.

FIG. 2 shows a SEM photo of the conducting layer 5. The layer 5 comprises metallic particles (dark particles) 9 which enclose transparent areas 7. The metallic particles 9 have an average size of 2–8 nm. The transparent areas 7 have an average size of 20–35 nm. The metallic particles 9 ensure, via mutual contact, electrical conductance and enclose transparent areas 7. The structure formed may be described as a soap bubble structure, in which the transparent "bubbles" lie in a sea of metal particles which are in mutual contact with each other. The transmission of light takes place through the transparent areas 7, while the electrical conductance takes place through the contacts between the metal particles 9. On average, the metallic particles 9 are smaller than 20 nm and larger than 1 nm. On average, the transparent areas are preferably more than twice as large as the metallic particles 9. The thickness d1 of the conducting layer 5 is preferably not more than 1.5 times the average size of the transparent areas 7. The metal particles 9 preferably comprise a metal of the group constituted by silver, palladium, ruthenium, rhodium, gold or platinum. An example of such a layer is described in WO 98/497.07.

Figure 3:
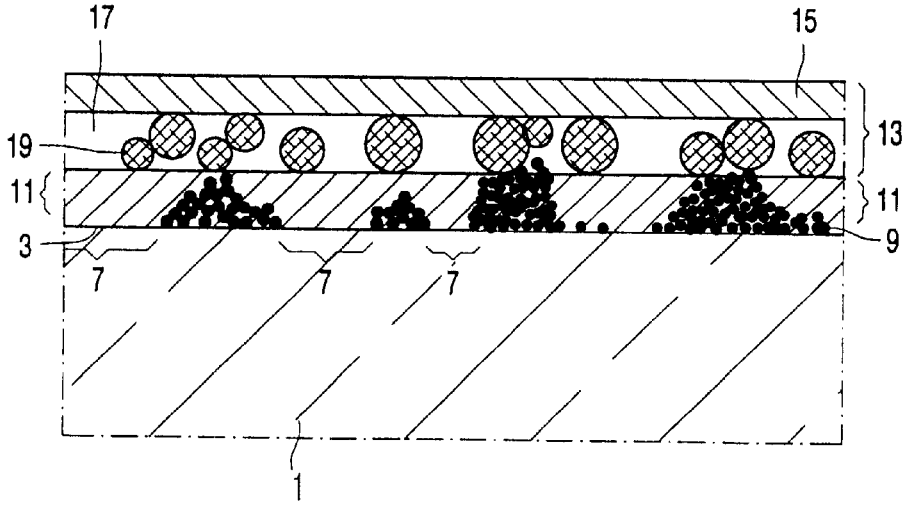
FIG. 3 is a cross-section of a part of the display device according to the invention.

FIG. 3 is a cross-section of a display screen 1, a surface 3 of which is provided with an anti-reflection filter and an electrically conducting strip 13 comprising a metal layer 15 and an adhesive layer 17 provided with electrically conducting particles 19, the metal layer 15 being in local electrical contact with the metallic particles 9 of the anti-reflection filter via the conducting particles 19 of the adhesive layer 17.

Satisfactory results were achieved if the conducting particles 19 in the adhesive layer 17 comprise a material chosen from the group of aluminum, silver, carbon, nickel, copper, gold, ruthenium oxide, ITO (indium tin oxide) or ATO (antimony tin oxide). The particles may be built up of a non-conducting core on which an electrically conducting layer is provided.

Figure 4A:
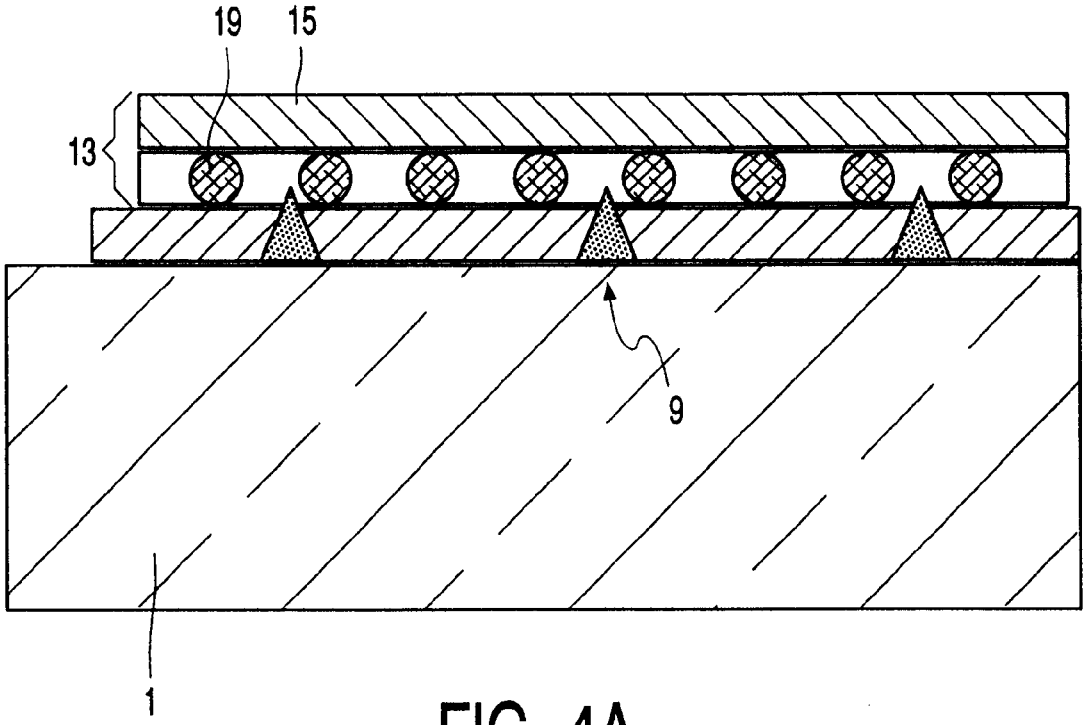
FIGS. 4A and 4B illustrate embodiments of the display device according to the invention.
Figure 4B:
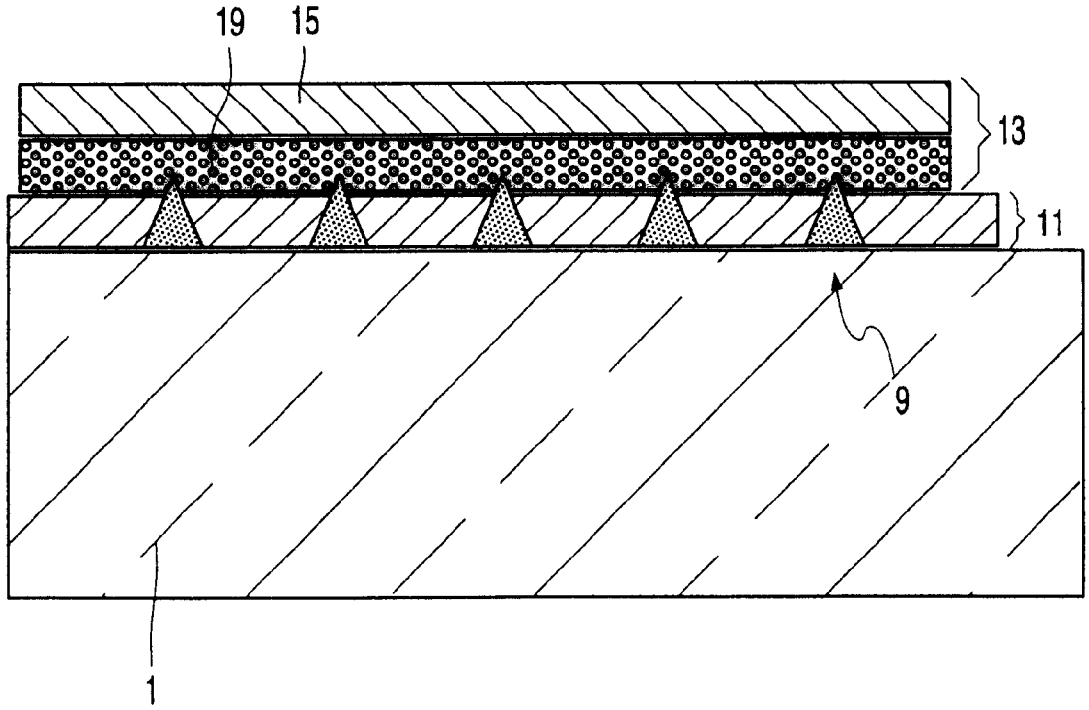

FIGS. 4A and 4B illustrate embodiments of the display device according to the invention. It is important that a satisfactory electrical contact is realized between the metallic particles 9 of the anti-reflection filter and the conducting particles 19 in the metal strip 13. In the Figures, the metallic particles 9 are shown diagrammatically as pyramids whose peaks protrude from the transparent layer 11. FIG. 4A shows a situation in which the metallic particles in the adhesive layer 17 have a relatively large dimension with respect to the dimensions of the pyramids. It has been found by experiments that, in that case, not every pyramid is in electrical contact with the metallic particles 9. If, as shown in FIG. 4B, the dimensions of the metallic particles are chosen to be small in proportion to the dimensions of the pyramids, the electrical contact between the anti-reflection filter and the electrically conducting strip 13 is further enhanced.

A satisfactory electrical contact between the anti-reflection filter and the metal strip 13 is obtained if at least 30% of the volume of the adhesive layer 17 is filled with the electrically conducting particles 19. A further improvement of the display device is obtained if the electrically conducting strips 13 have a width of at least 0.3 cm. At a higher filling degree of the conducting particles in the adhesive layer 17, the width of the strip may be reduced while still maintaining a satisfactory electrical conductivity of the strip. Satisfactory results are obtained with filling degrees of between 30% and 80% and widths of the strip 13 varying between 0.3 and 1.0 cm. When using broader strips 13, it is sufficient to use only one or two strips 13 so that the cost price of the product decreases. A satisfactory electrical contact is obtained when use is made of broader strips provided on the edges of the display screen in such a way that the strip makes contact over half its width with the front side of the display screen 1 and the other half makes contact with the sides of the display screen and simultaneously also with the rim band (anti-explosion band). This way of providing the strips has the additional advantage that, in the case of breakage of the display screen, possible loose glass parts are held together so that the risk of possible injuries of viewers is reduced.

A satisfactory electrical conductance of the strip is obtained when the metal layer 15 of the strip 13 comprises aluminum or copper. Such materials have the additional advantage that they are substantially impermeable to oxygen and ozone. A possible attack of the adhesive layer by said gases is thereby prevented and the lifetime of the strip 13 is increased.

Strips having the above-mentioned properties are commercially available from, inter alia, the firm 3M under the name of Scotch Foil Shielding Tapes.

Figure 5:
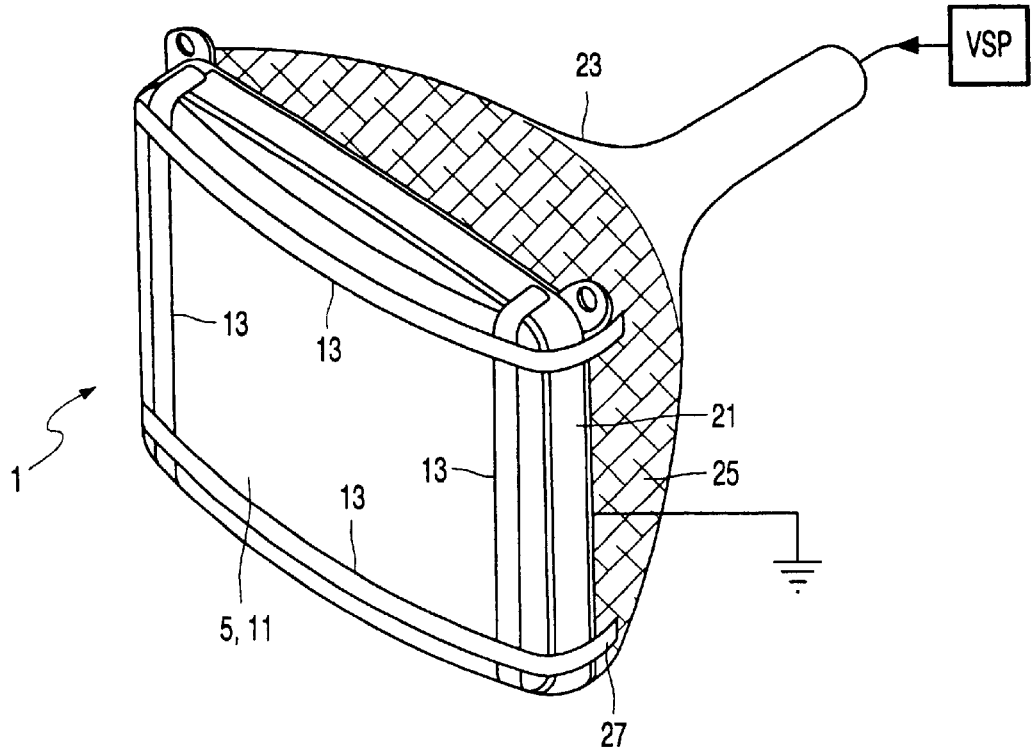
FIG. 5 is an elevational view of a display device according to the invention.

FIG. 5 shows a picture display apparatus comprising a video signal processor VSP for generating a picture signal, and a display device provided with an anti-reflection filter 5, 11 and several electrically conducting strips 13. The strips are provided on the edges of the display screen 1 and are in contact with a rim band 21 provided around the display screen. Since the rim band is connected to earth potential, the display screen 1 is also earthed via the electrically conducting strips 13. Due to the above-mentioned measures, troublesome AEF fields are shielded adequately.

FIG. 5 also shows a display device comprising a funnel-shaped portion 23 which is secured to the display screen 1, which funnel-shaped portion is at least partly provided with an electrically conducting layer 25, the conducting strip 13 being also in electrical contact with the electrically conducting layer 25. The electrically conducting layer 25, which generally comprises graphite, is provided on the outer side of the funnel-shaped portion. Together with a conducting coating on the inner side of the funnel-shaped portion, layer 25 forms a capacitance ensuring that the display device is safeguarded against harmful consequences of possible high-voltage flashover. This capacitance is incorporated in an electric circuit which is connected to a ground potential. The strips 13 are extended and are also in electrical contact with the conducting layer 25. Due to this measure, the customary earth potential contact, which is generally realized by means of some wires and springs, may be dispensed with. The cost price of the display device is thereby further reduced.

Figure 6:
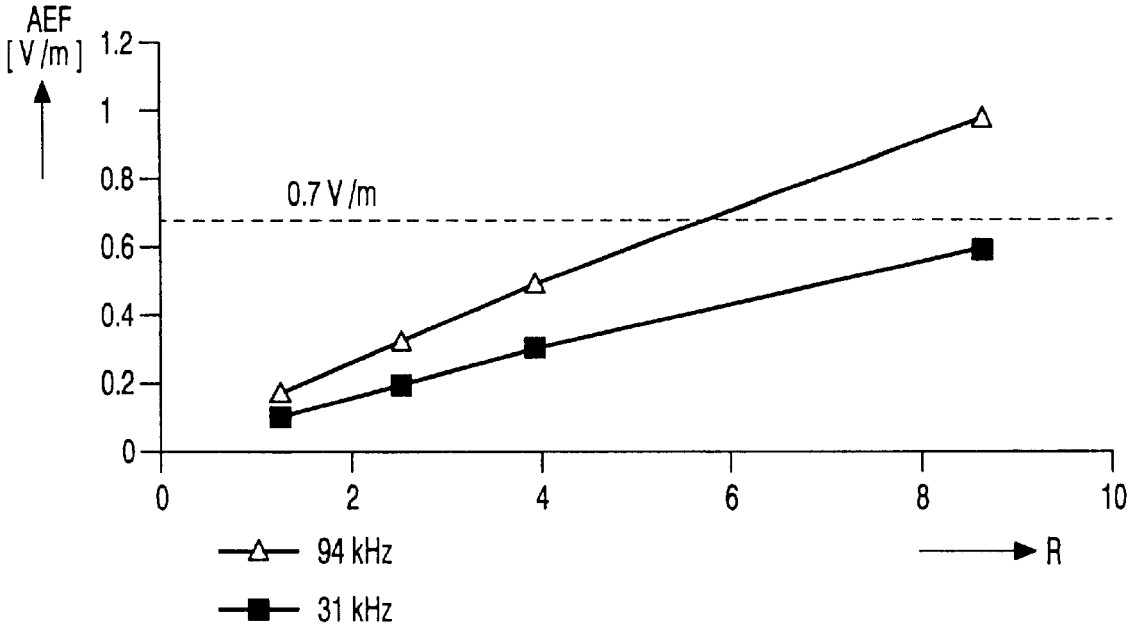
FIG. 6 shows the results of AEF field strength measurements in display devices according to the invention.

FIG. 6 shows the results of AEF field strength measurements as a function of the square resistance R in kohm/square of the conducting layer 5 of the anti-reflection filter. These measurements were performed in 2 frequency ranges of the AEF field. By means of a broken line, the Figure also shows the maximally allowed value of the AEF field which may be at most 0.7 V/m. The measurements proved that a sufficient AEF field shielding was obtained with a conducting layer having a resistance of approximately 5 kohm. This is important because the cost price of conducting layers is dependent on the square resistance, i.e. the higher the square resistance, the lower the cost price of the conducting layer. A considerable cost reduction of the display device can be realized when conducting layers having a square resistance of 5 kohm are used.

In summary, the invention may be described as follows. A display screen 1 of a display device is provided with an anti-reflection filter 5, 11 and at least one electrically conducting strip 13. The anti-reflection filter 5, 11 has a conducting layer 5 comprising metallic particles 9 and transparent areas 7, while a further transparent layer 11 is applied on the conducting layer 5. The transparent layer 11 has a thickness d2 which is smaller than or equal to the thickness d1 of the conducting layer 5. The electrically conducting strip 13 comprises a metal layer 15 and an adhesive layer 17 which is provided with electrically conducting particles 19. The electrically conducting strip 13 is in local electrical contact with the metallic particles 9 of the anti-reflection filter 5, 11, so that a satisfactory reduction of AEF fields is obtained.

It is to be noted that the above-mentioned embodiments have been described to elucidate the invention, but the invention is not limited thereto. Those skilled in the art will undoubtedly be able to design many alternative embodiments without departing from the protective scope of the appendant claims. The references between parentheses in the claims should not be interpreted as limiting the claim. The word "comprise" and its conjugations does not exclude the presence of steps or means other than those mentioned in a claim.

What is claimed is:

1. A display device comprising a display screen, a surface of which is provided with an anti-reflection filter having a conducting layer comprising metallic particles and transparent areas, the conducting layer being provided with a transparent layer, wherein:

the transparent layer has a thickness which is smaller than or equal to the thickness of the conducting layer, the thickness of each layer being measured from the surface of the display screen up to the upper side of the layer, the display screen being provided with at least one electrically conducting strip comprising a metal layer and an adhesive layer provided with electrically conducting particles, the electrically conducting strip being in local electrical contact with the metallic particles of the anti-reflection filter via the conducting particles of the adhesive layer.

2. The display device of claim 1, wherein at least 2% of the volume of the adhesive layer is filled with the electrically conducting particles.

3. The display device of claim 1, wherein at least 30% of the volume of the adhesive layer is filled with the electrically conducting particles.

4. The display device of claim 1, wherein the strip has a width which is larger than or equal to 0.3 cm.

5. The display device of claim 1, comprising a funnel-shaped portion which is secured to the display screen, which funnel-shaped portion is at least partly provided with a second conducting layer, wherein the conducting strip is also in electrical contact with the second conducting layer.

6. A display apparatus comprising means for generating a picture signal, and a display device as claimed in claim 1 for displaying the picture signal.

* * * * *